US007252204B1

(12) United States Patent
Small

(10) Patent No.: US 7,252,204 B1
(45) Date of Patent: Aug. 7, 2007

(54) COMBINATION LOCK CONTAINER

(76) Inventor: Steven Douglas Small, 1649 Novato Blvd. Apt. #4, Novato, CA (US) 94947

( * ) Notice: Subject to any disclaimer, the term of this patent is extended or adjusted under 35 U.S.C. 154(b) by 0 days.

(21) Appl. No.: 11/501,569

(22) Filed: Aug. 9, 2006

Related U.S. Application Data

(60) Provisional application No. 60/759,508, filed on Jan. 17, 2006.

(51) Int. Cl.
*A61J 1/00* (2006.01)
*B65D 55/02* (2006.01)

(52) U.S. Cl. ..... 215/206; 215/201; 215/208; 215/230; 220/8; 70/58; 70/166; 70/312; 206/459.5; 210/212

(58) Field of Classification Search ..... 215/230, 215/206, 207, 208; 206/459.5, 806; 210/210, 210/212; 222/153.01, 153.13, 153.14; 220/8, 220/686, 737, 739; 70/166, 58
See application file for complete search history.

(56) References Cited

U.S. PATENT DOCUMENTS 430,261 A * 6/1890 Alternus, Jr. ..... 70/312

(Continued)

FOREIGN PATENT DOCUMENTS

EP 43859 A1 * 1/1982

OTHER PUBLICATIONS

Franklin Machine Products, Bottle Lock Liquor Locker. See attached.

(Continued)

*Primary Examiner*—Brian E. Glessner
*Assistant Examiner*—Alyson M. Merlino

(57) ABSTRACT

A combination lock container (10), suitable for accepting a wine bottle, consisting of an upper housing (12), a lower housing (50), a plurality of tumblers (18A-18E), and externally applied indicia (24). Cylindrical walls, or skirt portions, of each housing nest and engage into one another. Each housing has a key-like feature, consisting of a linear array of tabs with gap spacing between, that projects radially from the outer cylindrical wall surface. The upper housing has a longitudinal slot opening in the cylindrical wall, adjacent to its set of tabs, which can accept the tabs of the lower housing. When the housings are fully assembled, matching tab and gap features on each housing are adjacent and in lateral alignment with respect to each other. A plurality of tumblers, each with an internal annularly formed locking rib, are placed concentrically around the housings. The locking rib wall has a section removed that creates a keyway opening, the width of which is slightly greater than that of the aligned tabs. Located on the tumbler's outer circumference, and directly above the keyway, is a score mark or keyway indicator. Applying a personalized code word to the locking mechanism requires no disassembly. By using the keyway indicator features, indicia may be applied externally such that designated letters of a code word can be applied and aligned directly over the tumbler keyway. Once applied, the indicia conceal the location of the score marks. Locking ribs rotate through and intersect the laterally aligned gaps between the housing tabs, thus axially locking the housings together. When the proper code word is positioned underneath a marker, all keyways fall into alignment with the housing tabs. In this unlocked condition, the housings may be separated and the bottle of wine removed. A slot opening in the upper housing additionally allows the container to be used as a coin bank.

10 Claims, 9 Drawing Sheets

U.S. PATENT DOCUMENTS

| | | | | | |
|---|---|---|---|---|---|
| 841,668 | A | * | 1/1907 | Cowles | 215/206 |
| 1,195,745 | A | | 8/1916 | Snyder | |
| 1,280,700 | A | * | 10/1918 | Fouche | 141/381 |
| 1,358,352 | A | | 11/1920 | Wheelock | |
| 1,580,573 | A | | 4/1926 | Schara | |
| 1,834,091 | A | * | 12/1931 | Cruse | 70/312 |
| 3,129,834 | A | * | 4/1964 | Kimball | 215/206 |
| 3,405,828 | A | * | 10/1968 | St. Pierre | 215/206 |
| 3,407,954 | A | * | 10/1968 | Millis | 215/206 |
| 3,445,021 | A | * | 5/1969 | Johnson | 215/206 |
| 3,684,117 | A | * | 8/1972 | Leopoldi et al. | 215/206 |
| 3,828,519 | A | * | 8/1974 | Levey | 53/420 |
| 3,843,007 | A | | 10/1974 | Meyer | |
| 4,354,365 | A | | 10/1982 | Mayer | |
| 4,445,348 | A | | 5/1984 | Saitoh | |
| 4,615,191 | A | | 10/1986 | Grandy | |
| 4,782,963 | A | * | 11/1988 | Hunter | 215/206 |
| 5,277,325 | A | * | 1/1994 | Yan | 215/206 |
| 5,284,262 | A | * | 2/1994 | O'Nan | 215/206 |
| 5,605,242 | A | * | 2/1997 | Hwang | 220/8 |
| 5,722,547 | A | * | 3/1998 | Shankland | 215/230 |
| 6,021,653 | A | | 2/2000 | Pimpo | |
| 6,059,132 | A | | 5/2000 | Benjamin | |
| 6,089,480 | A | * | 7/2000 | Rawlings | 241/73 |
| 6,109,996 | A | * | 8/2000 | Ma et al. | 446/8 |
| 6,311,840 | B1 | * | 11/2001 | Shrader | 206/459.1 |
| 6,604,643 | B1 | | 8/2003 | Michael et al. | |
| 6,621,405 | B1 | | 9/2003 | Basche et al. | |
| 6,912,878 | B2 | | 7/2005 | Belden, Jr. | |
| 7,107,803 | B1 | * | 9/2006 | Swanson | 70/289 |
| 2005/0288082 | A1 | * | 12/2005 | de la Huerga | 463/9 |
| 2006/0043050 | A1 | | 3/2006 | Belden, Jr. | |

OTHER PUBLICATIONS

Crypted Security Boxes. http://www.cryptex.org/.
Encrypta Cryptex. http://www.encryptagifts.com/.

* cited by examiner

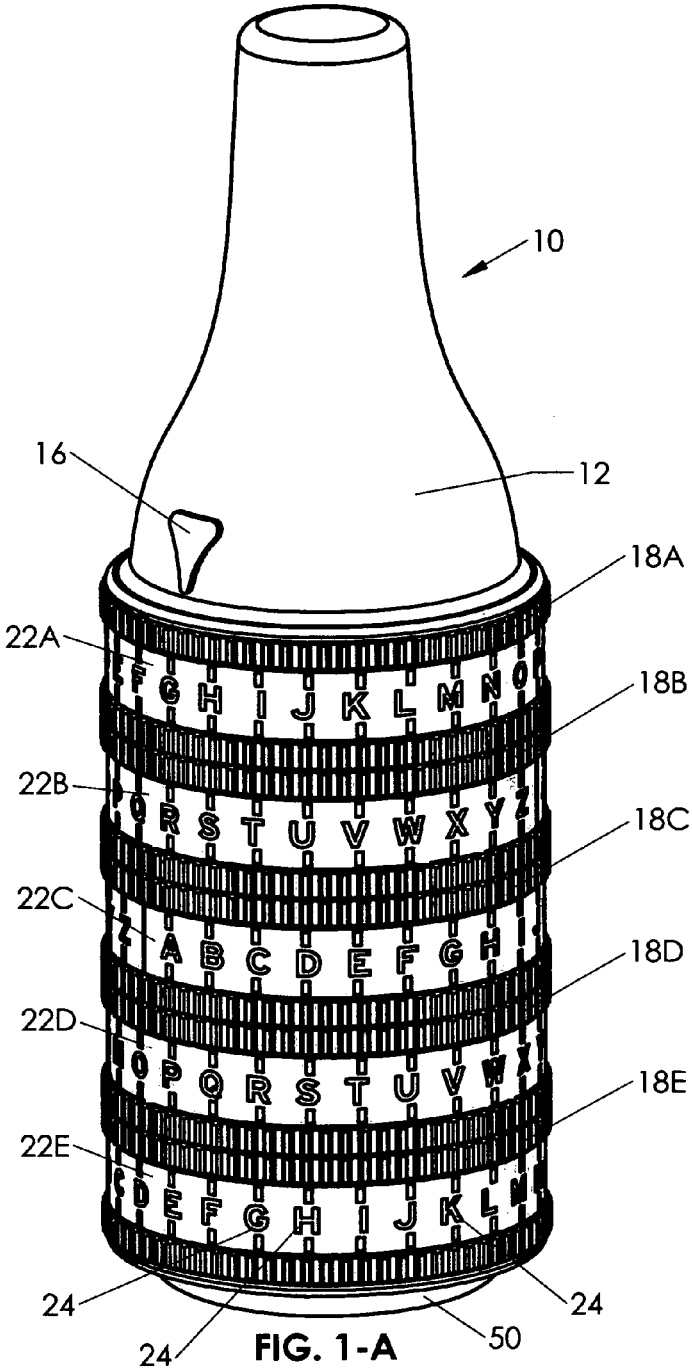
FIG. 1-A
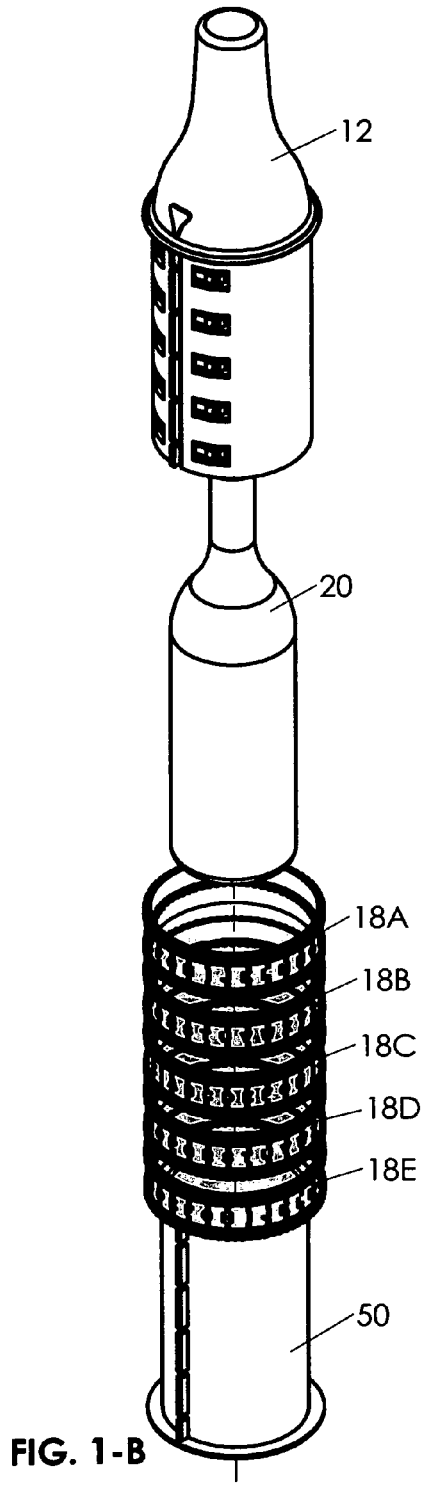
FIG. 1-B

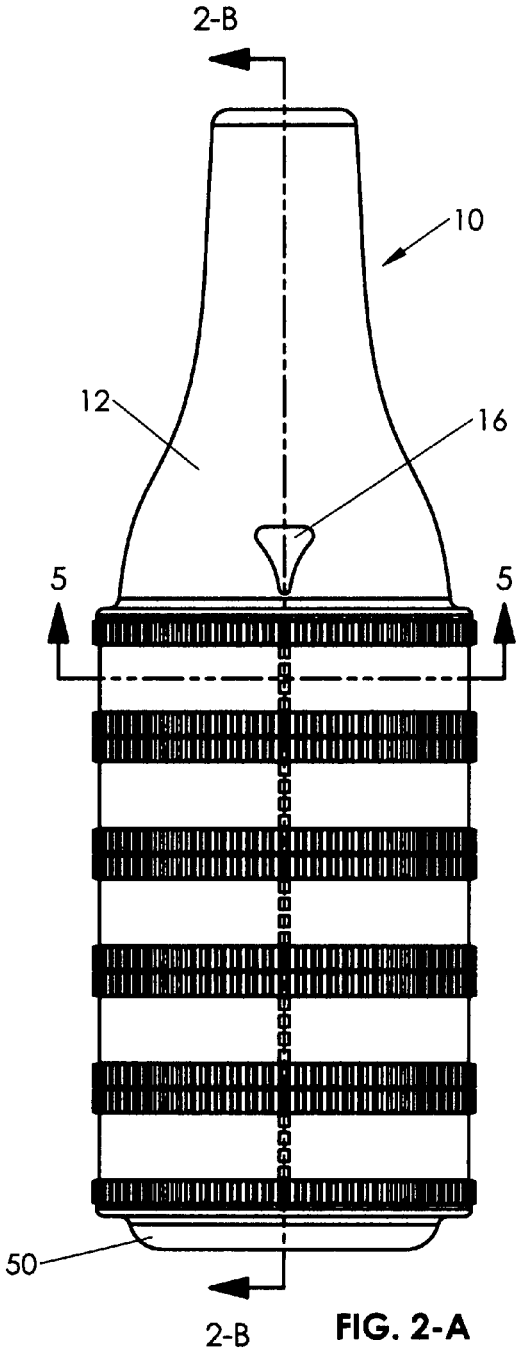
FIG. 2-A
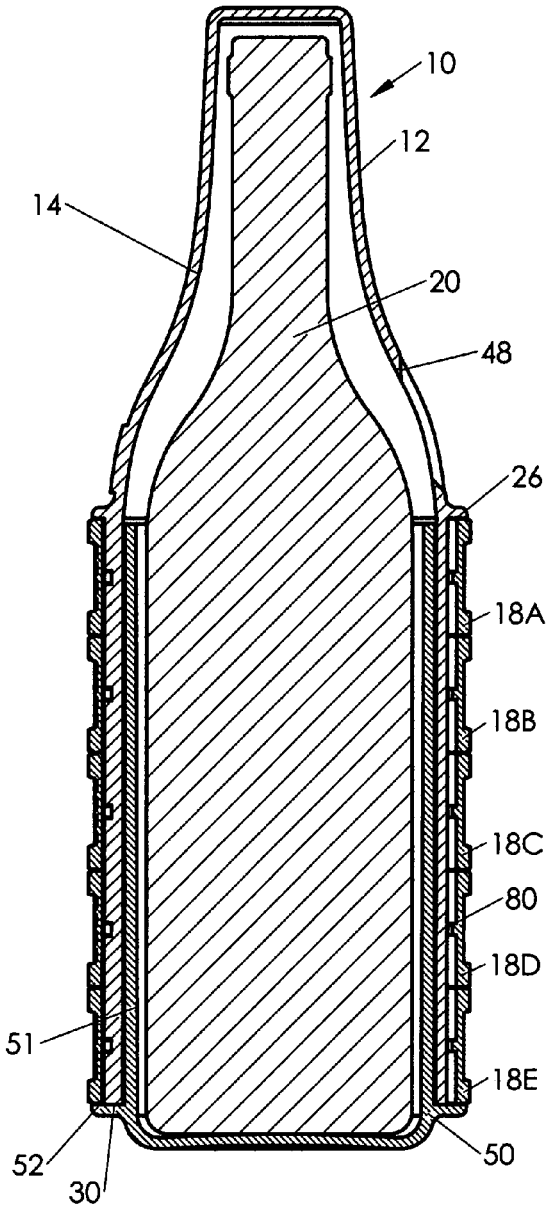
FIG. 2-B

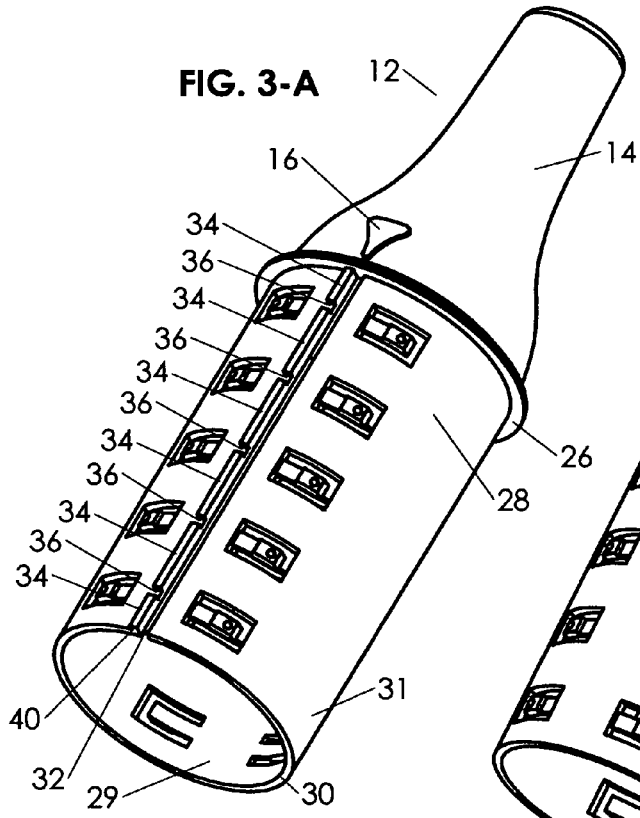
FIG. 3-A
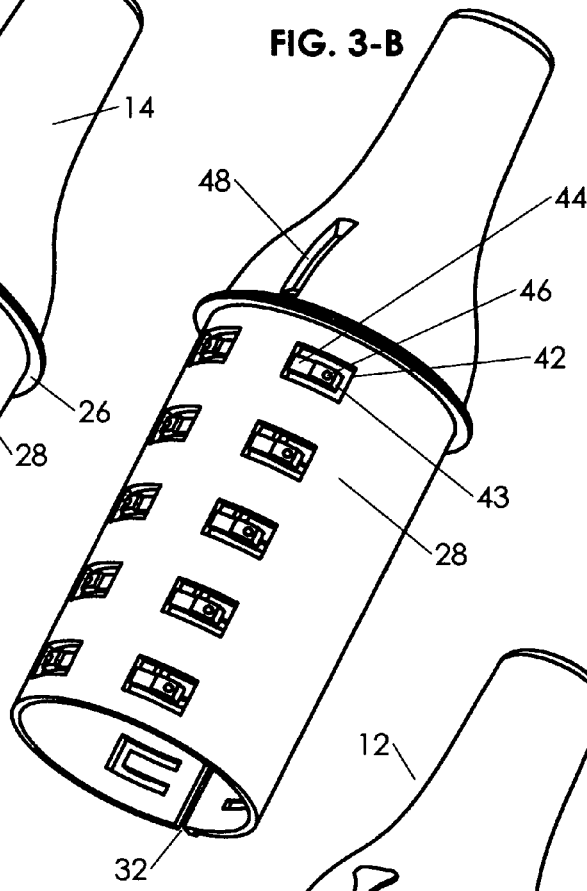
FIG. 3-B
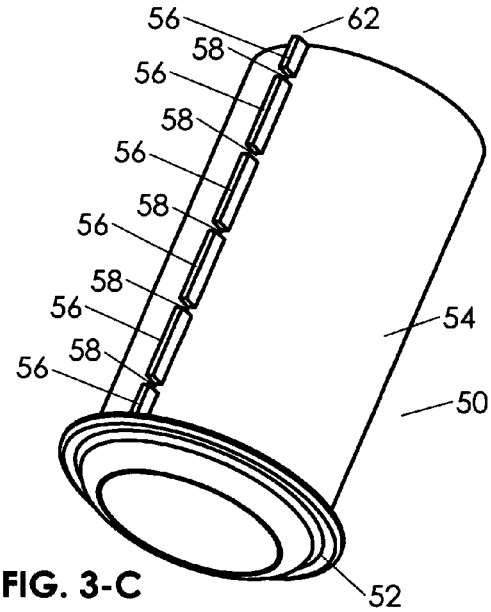
FIG. 3-C
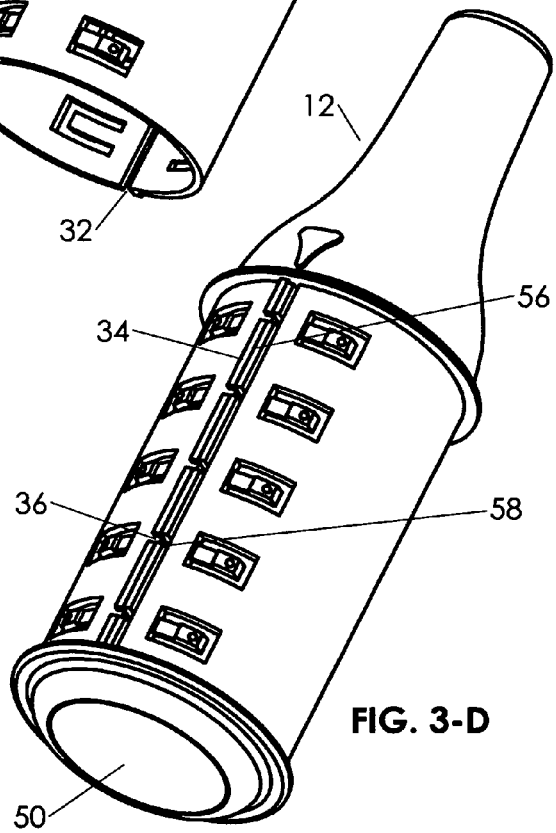
FIG. 3-D

FIG. 4-A
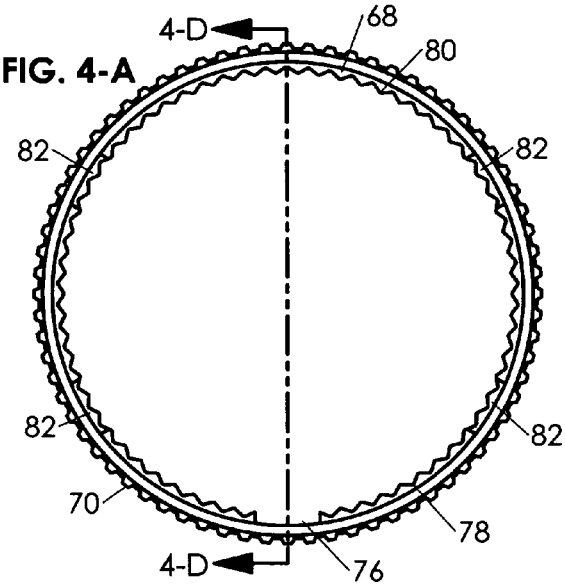
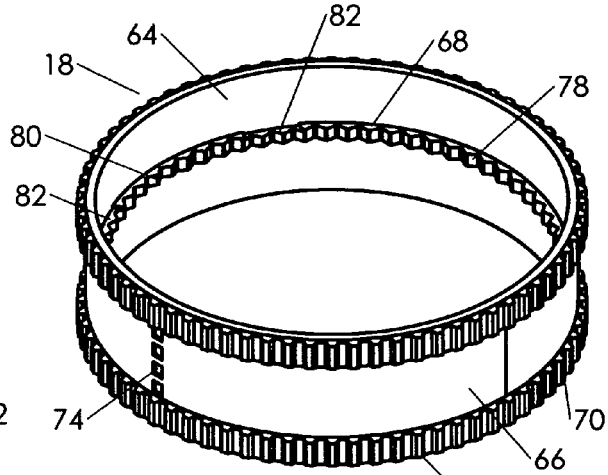
FIG. 4-B
FIG. 4-C
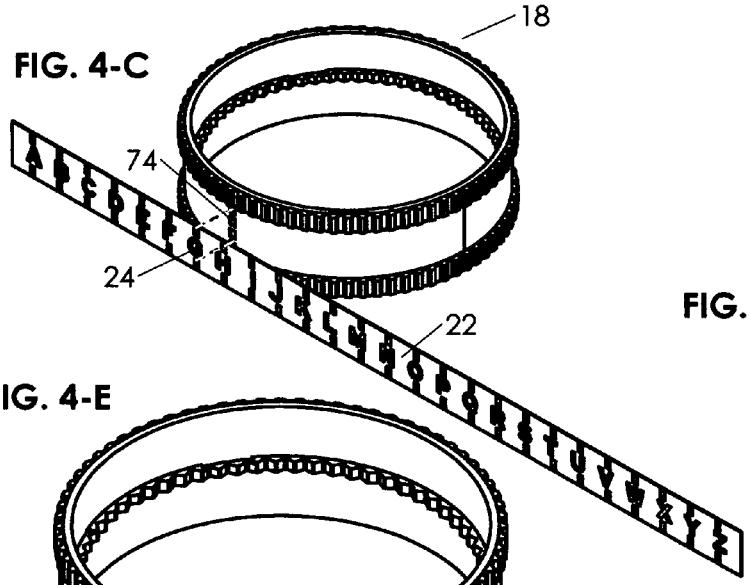
FIG. 4-D
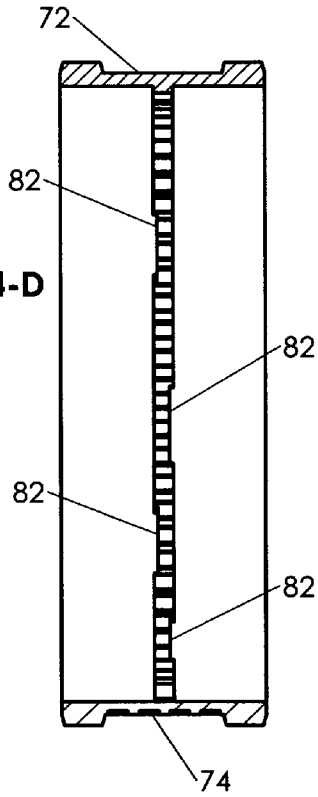
FIG. 4-E
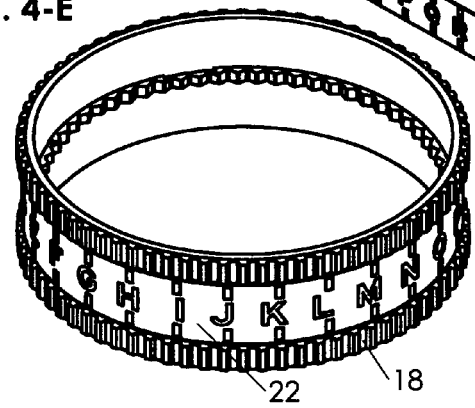

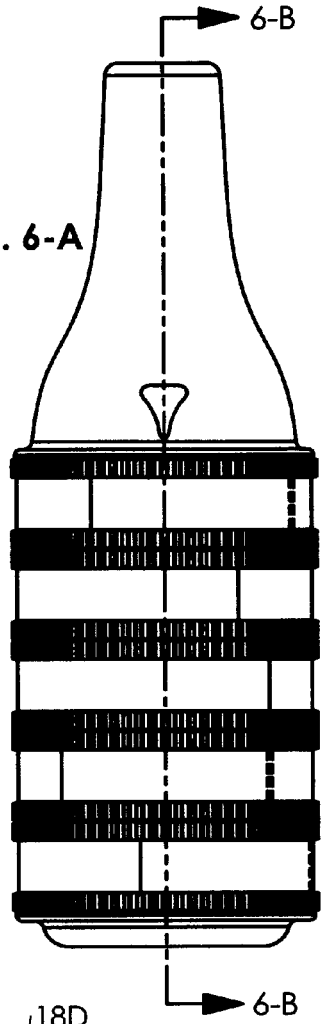
FIG. 6-A
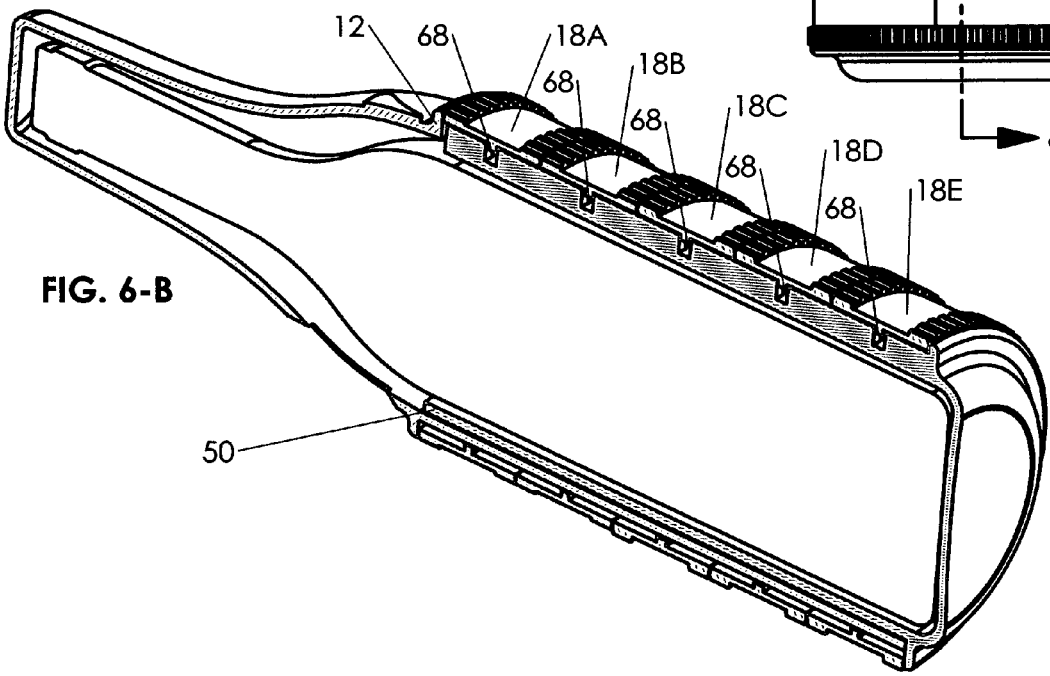
FIG. 6-B

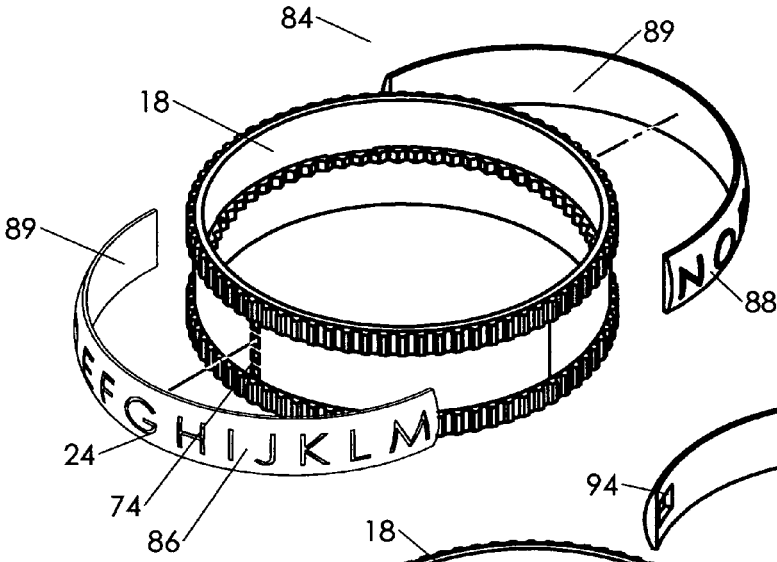
FIG. 7-A
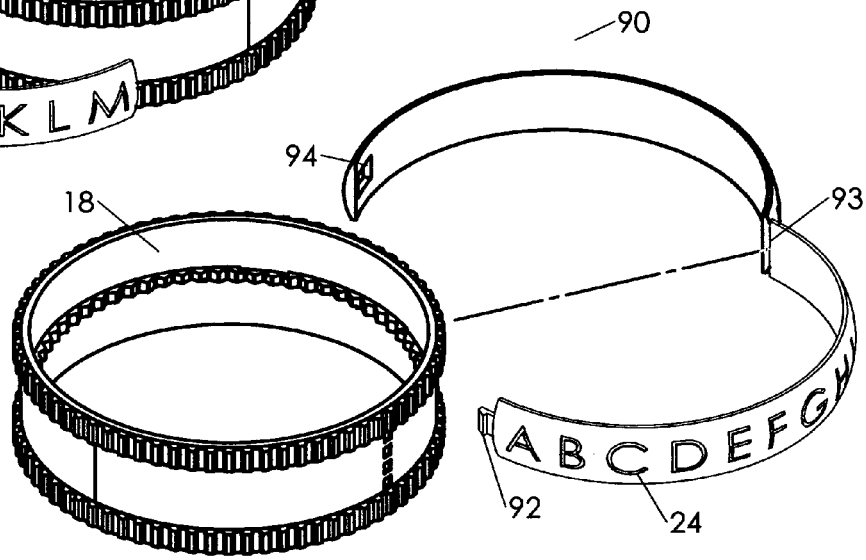
FIG. 7-B
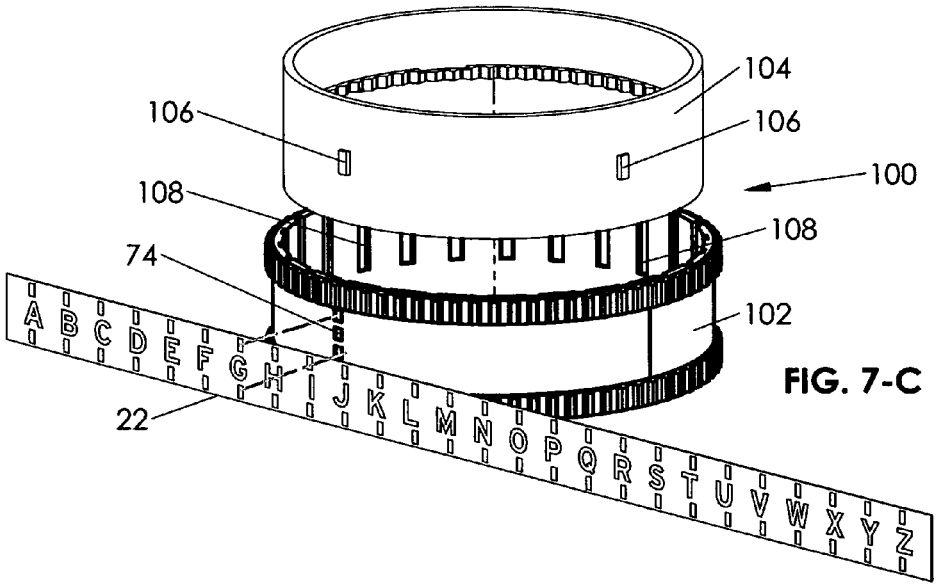
FIG. 7-C

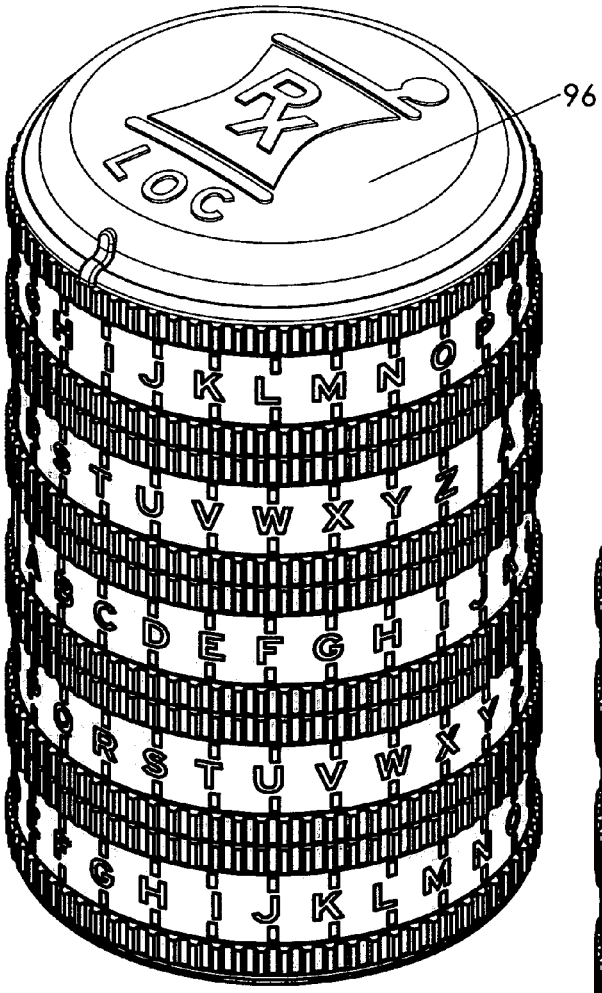
FIG. 8-A
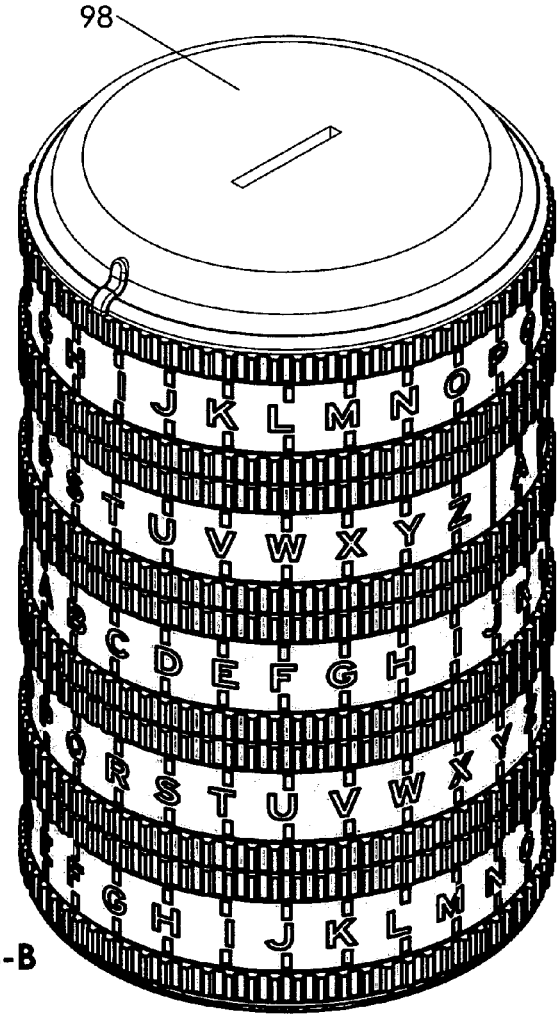
FIG. 8-B

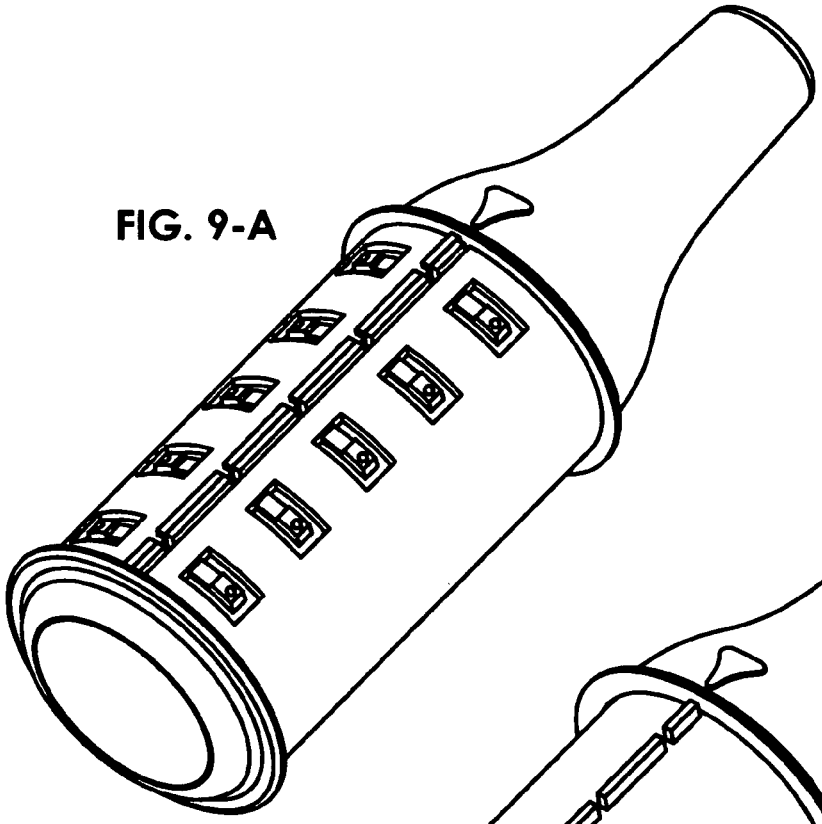
FIG. 9-A
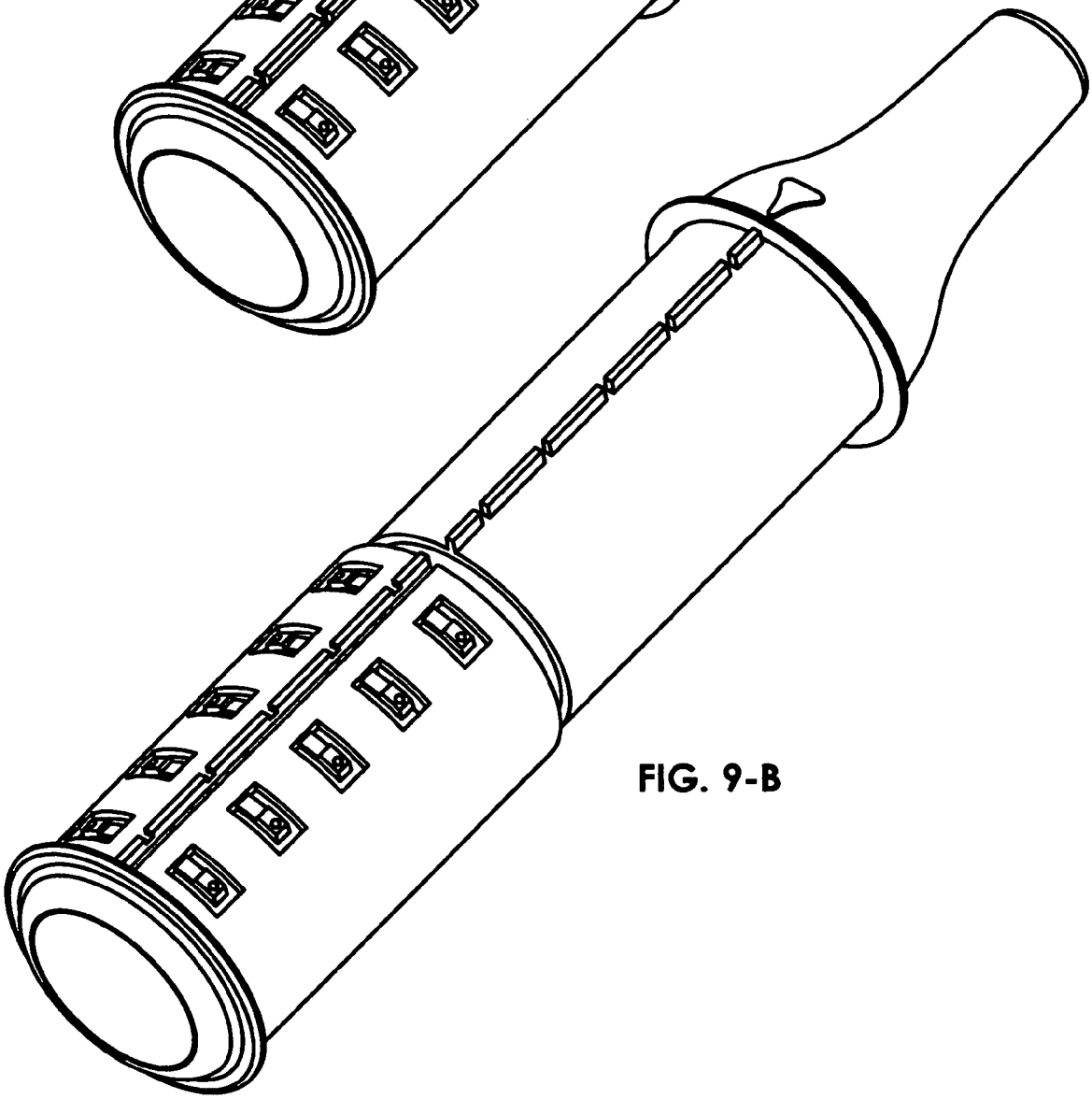
FIG. 9-B

COMBINATION LOCK CONTAINER

CROSS-REFERENCE TO RELATED APPLICATIONS

This application claims the benefit of PPA Ser. No. US60/759,508, filed 2006 Jan. 17 by the present inventor.

FEDERALLY SPONSORED RESEARCH

Not Applicable

SEQUENCE LISTING

Not Applicable

BACKGROUND OF THE INVENTION

1. Field of Invention

This invention relates to a cylindrical combination lock container.

2. Prior Art

Bottles of wine and spirits are often exchanged as gift items between people. Typically a bottle would be gift wrapped or placed in a decorative tote bag or box and then given as a present. Often times higher quality red wines (or scotch whiskeys) require aging to improve their characteristics. The bottle received is usually just set aside or "cellared" for several years. Although many people enjoy receiving wine, as a gift on its own, it is not particularly novel, fun, or unique. Presenting a special bottle of wine as a gift inside of a combination locking game puzzle (requiring a code word for opening) provides a fun and unique experience for both the gift giver and receiver.

Although the focus presented in this patent application centers around a lockable puzzle container for a wine bottle, there are other commercial applications for a locking container of this sort. For instance, in a different form factor the device could be suitable as a lockable storage container for securing medical supplies, pill bottles, etc. in the household. The container might allow medications to be readily accessible on a kitchen table but out of the hands of children. Alternatively, children might enjoy using a container designed as a piggy bank that can be set up with their own personally chosen code word. The container might also have another novel use as decorative locking container for holding cigars on an office desk top. The form factor of the container can have many variations that are different from and not limited to the shape of a bottle.

There are a number of inventions and products on the market related to securing the contents of bottles. The "Bottle Lock Liquor Locker", patent status unknown, (manufactured by Franklin Machine Products) is a bottle stopper that has three combination dials that when properly aligned will allow removal of the stopper. U.S. Pat. No. 1,358,352 to Wheelock (1920) shows another combination locking closure for an open bottle. Other locking devices that both attach to the bottles and act as theft deterrents are described in US Patent Application US 2006/0043050 A1 to Beldon, Jr. (2006) and U.S. Pat. No. 6,604,643 to Michael et al. (2003). Many devices and inventions have been designed specifically for securing medicine bottles with a programmable combination locking cap or closure. Such combination locking caps can be seen in U.S. Pat. Nos. 3,843,007 to Meyer (1974), 5,277,325 to Yan (1994) and 5,284,262 to O'Nan (1994). Again these devices relate more specifically to a locking cap that fits directly onto the open end of ajar or pill bottle.

There are many patented combination locking devices that allow users to set up or allow permutation of the combinations code. Most involve altering or resetting the tumblers indicia (such as numbers, letters, or symbols) relative to the tumbler internal keyway. Such devices are generally found and more closely related to the field of locks and in particular bicycle cable locks and padlocks. Most of the locking devices in which the combination may be set by an individual tend to be complex in nature and have many mechanical parts. U.S. Pat. No. 6,021,653 to Pimpo (2000) shows a tumbler ring that can be disassembled and have individual indicia plates applied into external slots. U.S. Pat. Nos. 4,615,191, 4,445,348, and 4,354,365 show several variations of two piece tumbler assemblies that allow inner and outer tumblers to have variable radial positions for changing the code. U.S. Pat. No. 6,059,132 to Benjamin describes a combination locking cap that uses flat circular labels to apply indicia. U.S. Pat. No. 6,621,405 B1 describes as word system and computer algorithm for determining a limited set of useable code words for a combination lock. All of the above locking devices require a significant amount of time, assembly effort, and mechanical aptitude on the part of the end user to take apart the device and reset the combination.

More recently, a cylindrical combination locking device called a Cryptex had been introduced into the market place. The Cryptex has been made popular by author Dan Brown's novel "The Da Vinci Code" and its movie version. The book describes the Cryptex as being a cylindrical device used to secure and conceal small rolled up messages or notes on paper held within. It is also described as being similar to a combination bicycle cable lock. There does not appear to be any evidence that the Cryptex was actually invented by Leonardo Da Vinci, but rather that it was fictitiously conceived by the author. There are several commercial replica versions of the Cryptex device available that consist of a cylindrical device with letter coded tumblers. The Cryptex reproductions have held true to this "end use", described in the author's book, and have been designed to do little more than hold rolled up paper notes and possibly small articles such as pieces of jewelry. Many of these ornate and "antique-looking" collector's items are quite expensive and are fabricated from metals, stone, wood, or combinations thereof. Some Cryptex designs require the purchasers to contact the manufacturer and provide a custom code word beforehand to allow the engraving of the chosen letters on to the tumblers during manufacturing. Others Cryptex designs provide features that allow resetting of the combination by disassembly and reorientation of two piece tumblers whereby the internal keyways can be radially adjusted relative to the external portion of the tumbler's indicia. This method of varying the indicia for word permutations with two piece tumblers has been well described in the patents above relating to bicycle cable locks and padlocks. The Encrypta Cryptex puzzle, U.S. Patent Application US 2005/0288082 A1 to De la Huerga, uses wooden blocks, spacers, threaded posts, end pieces, to create a Cryptex. The De La Huerga uses an adjustable two piece tumbler design similar in nature to prior art cable locks. The lock body described (similar to an air cylinder assembly), consists of top and bottom sections, or end caps, with and post connectors or stand-offs extending between the two sections. All of the lock body elements of this design are necessary to retain the tumblers. A more desirable configuration would eliminate these components.

Although the above mentioned patents are discussed as prior art (locks designed for re-combination, combination locking closures for threaded medicine bottles, and Cryptex devices for concealing paper notes), none have strong correlation to the device in this application which pertains to a container that fully locks, encloses, and conceals a wine bottle.

OBJECTS AND ADVANTAGES

It is the object of the present invention to provide a combination locking container that has the following advantages which are:

(a) to provide a unique gift product that can be exchanged between wine enthusiasts that allows a fun treasure hunt type game and puzzle for a bottle of wine;

(b) to provide an additional use as a locking coin vault or "piggy bank";

(c) to provide use as a storage container for securing medicines and/or medical supplies;

(d) to provide ease in manufacture and assembly for high volume production as injection molded plastic parts;

(e) to require the fewest number of unique parts for any combination locking container that allows permutation of the combination code;

(f) to provide a product that can be sold at a relatively low cost;

(g) to provide end users the ability to select any code word using the entire twenty-six letter alphabet;

(h) to provide quick and easy set up and assignment of a personal code word without requiring disassembly;

(i) to provide "pick-resistant" features to prevent circumventing the locking mechanism; and (j) to provide integral tactile detent/ratchet features that help position tumblers without the requirement of additional parts.

Still further objects and advantages will become apparent from a consideration of the ensuing description and drawings

SUMMARY

The present invention provides a combination locking container that in one permutation can be used as a puzzle or treasure hunt game for exchange of a bottle of wine or spirits contained within. Different sized versions of the device may be constructed for tall or wide bottles, champagne bottles, cognac, liqueurs, etc. Likewise other permutations of the design may alter the housing's form factor and aesthetics to something more suitable for storing pill/medicine bottles or for storing cigars and a humidor within. The combination uses a code word that users may choose and easily apply with out disassembly of the device. Briefly, the principal upon which the locking mechanism is based calls for the alignment of a set of tumblers with internal keyways. When the tumblers are aligned to a marker with the letters spelling out the correct code word, the protruding tabs on both housings are allowed to pass through the tumbler keyways in an unobstructed manner-thus allowing the housings to be separated axially. The container uses two cylindrical housings (an upper and a lower) with interengageable portions that are locked together by a plurality of rotating tumblers. The upper housing and lower housing each have a set of tabs that provide a key feature. Each tumbler has a shallow cylindrically recessed surface on its exterior that is capable of accepting indicia. The recessed surface has score marks that indicate the presence and location of the keyway directly underneath. These indicated score mark locations on the tumblers allow letters of the code word to be applied directly to the tumbler's exterior surface without any disassembly or need for visual reference of the internal keyway. The preferred embodiment makes use of label strips with strong adhesive backing as means for applying indicia. Each label strip contains a twenty-six letter alphabet on the top surface and can be individually applied to the tumbler's exterior with the chosen letter radially aligned with the score marks and keyways. The labels are manufactured with opaque material such that once applied to the tumbler, the keyway marker is not visible. Use of the full 26 letter alphabet on each label allows the user numerous options in choices for code words. When the letters are properly aligned with the housing marker to spell out the selected code word, the housings may be slid apart and the bottle removed. Although the present design uses five tumblers, the design could use fewer or greater number of tumblers. The clues for solving the code can be exchanged between two people as a game until the person who has received the gift breaks the code, unlocks the container, and can gain access to their wine. An additional feature is a slotted opening in the upper housing that is suitably sized to accept a variety of coins, bills, etc thus allowing the container to be used as a locking coin/money bank once the bottle has been removed.

BRIEF DESCRIPTION OF THE DRAWINGS

FIG. 1-A is a view in perspective of the assembled device.

FIG. 1-B is an exploded view in perspective of the device.

FIG. 2-A is a front elevation view of the device with tumblers aligned to the unlocked position.

FIG. 2-B is a side sectional view of the device.

FIG. 3-A is perspective view of the upper housing showing front facing features.

FIG. 3-B is perspective view of the upper housing showing rear facing features.

FIG. 3-C is perspective view of the lower housing and front facing features.

FIG. 3-D is a perspective view of upper and lower housings assembled without tumblers.

FIG. 4-A is top view of a tumbler.

FIG. 4-B is perspective view of a tumbler.

FIG. 4-C is perspective view of a label prior to its application to the tumbler.

FIG. 4-D is a sectional view of a tumbler.

FIG. 4-E is a perspective view of a tumbler with applied label.

FIG. 6-A is a front view of the device (labels not shown) with tumblers in a locked position.

FIG. 6-B is a longitudinal sectional view in perspective showing locking engagement between the tumblers and the housings.

FIG. 7-A is an exploded perspective view of alternate embodiment using two split rings for externally applying indicia to a tumbler.

FIG. 7-B is an exploded perspective view of alternate embodiment using a single hinged ring with snap features for externally applying indicia to a tumbler.

FIG. 7-C is an exploded perspective view of alternate embodiment using a two piece tumbler assembly.

FIG. 8-A is a perspective view of a locking container version for intended use with medicine/pill storage.

FIG. 8-B is a perspective view of a locking container version for intended use as a coin bank.

FIG. 9-A is a perspective view of upper and lower housings assembled (cylindrical nesting, keying and detent features reversed).

FIG. 9-B is an exploded perspective view of upper and lower housings (cylindrical nesting, keying and detent features reversed).

Figure 5:
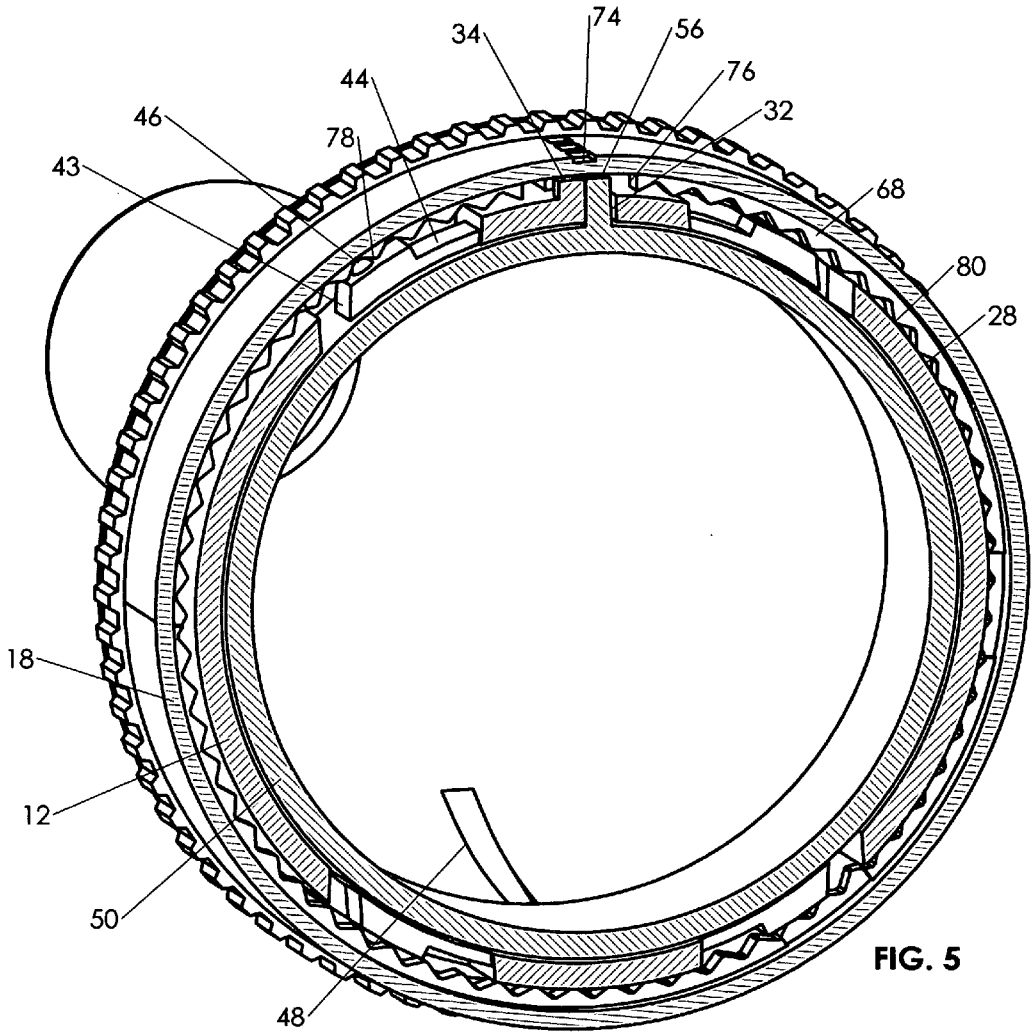
FIG. 5 is a sectional view in perspective showing engagement between a tumbler and the housings.

| DRAWINGS - - REFERENCE NUMERALS | |
|---|---|
| 10 | locking container assembly |
| 12 | upper housing |
| 14 | neck |
| 16 | marker |
| 18 | tumbler |
| 20 | wine bottle |
| 22 | labels |
| 24 | indicia |
| 26 | upper housing flange |
| 28 | upper housing cylindrical skirt |
| 29 | inside diameter of upper housing |
| 30 | end surface of upper housing |
| 31 | outside diameter of upper housing |
| 32 | upper housing slot |
| 34 | upper housing tabs |
| 36 | gaps between upper housing tabs |
| 40 | upper housing key |
| 42 | rectangular openings |
| 43 | detent tab |
| 44 | narrower section of detent tab |
| 46 | spherical bump |
| 48 | coin slot |
| 50 | lower housing |
| 51 | inside diameter of lower housing |
| 52 | lower housing flange |
| 54 | lower housing cylindrical skirt |
| 56 | lower housing tabs |
| 58 | gaps between lower housing tabs |
| 62 | lower housing key |
| 64 | inside diameter of tumbler |
| 66 | outside diameter of tumbler |
| 68 | locking rib |
| 70 | knurls |
| 72 | channel |
| 74 | keyway indicator |
| 76 | keyway |
| 78 | detent notch |
| 80 | inner edges of detent notch |
| 82 | recess for pick resistance |
| 84 | split ring set |
| 86 | front indicia ring |
| 88 | rear indicia ring |
| 89 | inner surface of split rings |
| 90 | clasp indicia ring |
| 92 | snap leg feature |
| 93 | living hinge |
| 94 | pocket recess |
| 96 | locking container for securing medicines |
| 98 | piggy bank |
| 100 | two piece adjustable tumbler |
| 102 | outer tumbler |
| 104 | inner tumbler |
| 106 | protruding teeth |
| 108 | blind slots |

DETAILED DESCRIPTION—FIGS. 1-A THROUGH 6-B—PREFERRED EMBODIMENT

A preferred embodiment of the container of the present invention is illustrated in FIGS. 1-A through 6-B. FIGS. 1-A & 1-B show the locking container assembly 10 consisting of an upper housing 12, a lower housing 50, five tumblers 18A-18E, and five labels 22A-22E with indicia 24 applied to the tumblers. The preferred embodiment uses injection molded plastic as the material for the housings and tumblers, however other suitable materials could be used in fabrication such as wood, die cast metals, etc. The plastic material used for part fabrication is opaque such that the wine bottle contained within cannot be identified. The container is designed to accept a standard 750 ml wine bottle 20. Because of the numerous varieties of bottle shapes sold in the marketplace, the internal volume within the container is not suitable to fit every wine bottle. The form factor, size, and profile could be adjusted for various versions of the device to accept tall/wide bottles, cognac & champagne bottles, etc. A marker 16 is provided on the upper housing 12 for alignment of indicia 24 underneath. When the indicia spell out the correct designated code word, the device can be unlocked and separated axially, allowing access to the bottle. In FIG. 1-A the indicia are shown aligned underneath the marker to spell out the code word "GRAPE".

FIGS. 2-A & 2-B show the container 10 in front and section views respectively with inserted wine bottle 20. Note that the labels are not illustrated. FIG. 2-B shows the upper housing 12 extending upwardly and narrowing to form a neck 14 that follows the basic contour and shape of a wine bottle. The inside diameter of lower housing 51 is sufficiently large enough to accept the wine bottle.

FIGS. 3-A through 3-D show upper housing 12 and lower housing 50 features. Shown in FIGS. 3-A & 3-B is the upper housing 12 in perspective, oriented to show front and rear facing surfaces respectively. The housing body consists of and upper housing cylindrical skirt 28 with a narrow flat upper housing flange 26 extending radially from top end of the skirt, and previously mentioned neck 14 portion. Previously mentioned marker 16, is an embossed feature projecting from the outer surface of the neck portion and generally above the flange. Alternatively, the marker could also simply be a pad printed symbol or icon. Below the marker, an upper housing key 40 is produced by a plurality of upper housing tabs 34 spaced at intervals longitudinally along the front facing portion of the cylindrical skirt. The tabs are generally rectangular in shape. Note that the key or tab features do not necessarily have to be rectangular. For instance these key features could be cylindrical pins projecting outwardly. The gaps 36 between upper housing tabs provide spacing for the inner tumbler ribs to rotate and pass through, which will be discussed shortly. Adjacent to the upper housing key 40 is upper housing slot 32 that runs longitudinally alongside the key. The width of the slot is sufficient to accept the lower housing key 62 with a small amount of clearance for sliding and insertion.

FIG. 3-C shows lower housing 50 where the body consists of a lower housing cylindrical skirt 54 with a narrow flat lower housing flange 52 extending radially from bottom end of the skirt. The outside diameter of lower housing skirt is sized to concentrically fit up and into the inside diameter of upper housing 29 with a small amount of radial clearance between the two housings. Similar to the upper housing 12, the lower housing key 62 is produced by a plurality of lower housing tabs 56 spaced at intervals longitudinally along the front facing portion of the lower housing cylindrical skirt.

The tabs of the lower housing are rectangular in shape as well. Gaps 58 between lower housing tabs provide spacing for the inner tumbler ribs to rotate and pass through. FIG. 3-D shows the full insertion, or concentric nesting, of the lower housing up and into the upper housing. Now referring back to FIG. 2-B cross-sectional view, full insertion or mating of the upper and lower housings is achieved when the end surface 30 of upper housing stops against and comes into flush contact with upward facing surface of lower housing flange 52. Referring back to FIG. 3-D, when both housings are fully engaged, the gaps and tabs for both housings are in lateral alignment with respect to each other. The gaps provide a channel for tumblers to lock both housings together. Note that besides having the gaps and tabs in axial alignment when housings are engaged, it is desirable to have the height profiles of all the tabs match each other as shown. To accomplish this, the lower housing tabs are slightly taller, or project further off of their skirt, in comparison to those on the upper housing.

Although the preferred embodiment shows the upper and lower housing skirt features nesting and engaging concentrically, other methods for engagement are possible. For instance, both housings could have a staggered array of partial cylindrical wall sections, all the same diameter, with spacing intervals in between, in a radial arrangement. Partial cylindrical wall sections of each would inter-engage into the void areas or spaces on the opposing housing. Edges of these cylindrical wall sections could key or dovetail together. When both housings are assembled together, the mated opposing wall sections would form a closed cylinder.

FIG. 3-B shows a plurality of detent tabs 43 formed on the upper housing cylindrical skirt 28. Each detent tab is cantilevered from an inner side wall of rectangular openings 42 in the skirt. Formed on the top surface of each detent is a spherical bump 46. These bumps engage v-shaped notches that are present in the inner rib of the tumbler-which will be discussed shortly. A reduced wall section 44 of the detent tab allows for flexure of the tab as the bump feature rides into and out of the tumbler notch peaks and valleys—to be discussed shortly. Also shown on rear facing portion of upper housing is a coin slot 48. With the wine bottle removed, the coin slot allows the container to additionally be used as a piggy bank whereby coins, bills, etc. can be dropped into and locked inside.

FIGS. 4-A through 4-E show the tumbler 18 and label 22 with indicia 24. FIG. 4-B shows a perspective view of a tumbler that is generally ring shaped or annular in form. The tumbler's locking rib 68 extends radially inwardly a short distance from the inside diameter 64 of the tumbler and is centered relative to the tumbler's height. FIG. 4-A shows a portion of the rib removed thus creating a keyway 76 opening in the locking rib. The width of the keyway is slightly greater than that of both adjacent and laterally aligned housing tabs—that are positioned side by side when assembled. Alignment of all tumbler keyways, with widths centered to and positioned directly over the keys of both housings, allow the tabs to pass through, and container to be taken apart. The locking rib also has a radial array of v-shaped cuts that intersect the rib to create a series of detent notches 78 with peaks and valleys. During tumbler rotation, the spherical bump features of the upper housing ride into and over of the peaks and valleys of detent notches causing flexure of the detent tabs.

Although the detent features provided are not a necessity, or a critical element of the locking mechanism, they do provide some additional functional advantages. The detent bumps engaging into the tumblers notches provide indexing of the tumbler relative to the marker on the upper housing and help prevent unwanted movement or "slippage" when one tumbler is properly indexed and an adjacent tumbler rotates and drags against it. Additionally, the tactile or "ratchet-like" feel provided by the detent action provides a higher perception of quality to the end user. The use of detent features for indexing tumblers on locks is common, i.e. spring loaded steel balls, however, this design provides the functionality without the need for these additional parts. Note, that although this preferred embodiment suggests a detent feature consisting of a cantilevered tab with a spherical bump, any integral formed feature on the housing that allows flexure of the plastic with some other form of protruding feature, i.e. tooth would be feasible as well.

The container is not considered to be a "high security" locking device, however extra features have been added to help prevent "picking" or easy circumvention of the keyed locking mechanism. Referring to FIGS. 4-A, 4-B, and 4-D, a plurality of shallow recesses 82 on both upper and lower facing flat surfaces of the locking rib 68 are present for "pick resistance". A typical attempt to "pick" a lock mechanism of this nature would include pulling on the key to load it against the locking tumblers, and then rotating the tumblers until an audible or tactile "click" is noticed. An audible or tactile "click" signals that the key has entered into the keyway. To "throw off" this type of circumvention, the recesses, or stepped surfaces, of the locking rib provide the same type of tactile indicator when the stepped surface rotates past the loaded key. Thus, these "anti-pick" features falsely give the impression that tumbler alignment has been achieved, when in fact the inner rib is still locking the keys together.

Still referring tot FIGS. 4-A through 4-E, two sets of knurls 70 extend in a radial array along top and bottom edges of the tumbler. The knurls provide easier means for gripping and rotating the tumblers during rotation. In addition, both knurl arrays on top and bottom edges create a channel 72 into which labels may be applied. The exterior surface on the outside diameter 66 of the tumbler has the presence of a keyway indicator 74. The indicator marking could be varied in design-score mark, dimples, etc, but the preferred embodiment shows it as a set or linear array of shallow recessed pockets. As the name suggests, the keyway indicator designates the center of the keyway inside the tumbler. When being set up for the first time use, the assembled container is provided with five loose or unattached adhesive labels 22. After a five letter code word has been selected, each letter of the code word can applied to the tumblers one at a time. FIG. 4-C shows the letter "G" of the label aligned with the keyway indicator. FIG. 4-E shows the label fully applied and wrapped around the tumbler. With the opaque labels covering the keyway indicator feature on the tumblers, the unlocking position of the tumbler concealed. If a person wishes to apply a new code word after the existing one has been solved, the channel in the tumbler is sufficiently deep enough to accommodate several layers of labels. A selected code letter on a new label would be aligned with the previous correct code letter on the old label. Although any label or externally applied indicia can be removed with some amount of effort, as previously mentioned, the container is not intended to provide a "high level of security" for its contents. There are, however, methods for making the removal of externally applied indicia more difficult. For instance to help prevent the labels from simply being "stripped off", a high strength adhesive backing may be used. Such types of strong label adhesives are commonly used for applying auto registration tags to license plates. Likewise the label itself can be perforated, partially sliced, etc. such that once applied, trying to remove it will be difficult and result in small pieces of the label to coming off rather than the entire strip. Alternate embodiments for means to apply the indicia externally will be discussed shortly.

FIG. 5 shows a cross-section of the container with a tumbler oriented to the unlocked or solved position and without label or bottle shown. As can be seen, keyway 76 opening is centered to both upper housing tabs 34 and lower housing tabs 56 allowing the housings to be separated axially. With the tumbler rotated away from this position, the housings are locked together via their keys and locking rib 68. The design of both upper and lower housings, interengaged with each other and having their own set of key tabs, permits the tumblers alone to lock and retain both housing together as one assembled unit, without the necessity of any additional parts. Keyway indicator 74 shown on the tumbler permits the code word to be applied via externally applied indicia without any disassembly. The cross-section shows details of the detent tab 43 with its engagement of spherical bump 46 into a valley of detent notch 78 of the tumblers locking rib 68. The locking rib, centered to the tumbler height, is in full alignment with the detent tabs and bumps. The coin slot 48 is also visible. The tumbler has radial bearing and guidance with the upper housing as inner edges 80 of detent notch make contact with the outer diameter of the upper housing cylindrical skirt 28.

FIGS. 6-A & 6-B show a front elevation and section view respectively of the device with the tumblers rotated to a locked condition. As can be seen in FIG. 6-B, the tumbler's locking ribs are engaged into the gaps between the key tabs thus axially locking the housings together. The upper and lower flanges present on both housings serve to contain the tumblers and close off their ends thereby concealing internal keyway features. Note that the use of two sets of tabs to create two sets of keys, one each on both upper and lower housing, eliminates the necessity of additional parts that would be required to retain the assembly.

OPERATION—PREFERRED EMBODIMENT

The device would be offered to the end user with housing and tumblers pre-assembled along with a set of labels-one for each tumbler. The directions to a consumer for setting up the device with a personal code word would be as follows:

1. Choose any five letter code word
2. Starting with top tumbler (the one nearest the marker on the upper housing) and ending with the bottom tumbler, apply each label, one at a time, with the chosen letter aligned to the keyway indicator (as shown in FIG. 4-C).
3. After all labels have been applied, align each tumbler such that the code word is spelled out below the marker on the upper housing.
4. With the neck end of the device pointed downwardly, axially slide/pull out the bottom housing.
5. Insert a bottle of wine neck first into the upper housing.
6. Re-insert the lower housing.
7. Scramble the code by rotating the tumblers.
8. At this point to device is ready to be given as gift. A game can begin whereby the receiver must solve clues that will lead to the code word.
9. When a new code is desired, new labels may be applied over the older coded labels.

ALTERNATIVE EMBODIMENTS—FIGS. 7-A THROUGH 9-B

As previously mentioned there are various ways for applying indicia externally to tumbler rings. All externally applied methods make use of a keyway indicator 74. FIG. 7-A shows the use of a split ring set 84 with indicia 24. The split ring set consists of a front indicia ring 86 and a rear indicia ring 88. Each split ring contains half of the alphabet or thirteen letters, i.e. front ring having letters A-M and rear ring having letters N-Z. Similar to the preferred embodiment, adhesive (not shown) on inner surfaces 89 of split rings can be used to retain the rings onto the tumbler 18. The split rings might be injection molded plastic or other suitable material such as wood or metal. Furthermore, rings could be split into a greater number of sections rather than just two. FIG. 7-B shows use of a clasp indicia ring 90. The clasp ring attaches to a tumbler in similar fashion as a bracelet fastens. The injection molded plastic ring may have a living hinge 93 one side with retaining features on the opposite side to close the open ends. Retaining features on the open ends could consist of a simple a snap leg feature 92 and pocket recess 94 for accepting the snap leg, although many different snap features are possible. This clasp ring version would be designed to tightly snap around the tumbler circumference to prevent "slippage" relative to the tumbler when being used. Mating teeth or meshing features could also be implemented that provide additional grip and engagement between the contacting surfaces. In other design variations for attachment, the open ends of the clasp could fasten to or engage directly into the tumbler as opposed to one another. Yet another possibility is for the ring to be semi-flexible or stretch and snap into a groove on the tumblers outer circumference.

FIG. 7-C shows an additional embodiment utilizing a two piece adjustable tumbler 100 similar to cable lock designs. The design differs from the others described above in that changing the combination would require disassembly of the tumblers. The two piece design makes use an outer tumbler 102, inner tumbler 104, and label 22. The inner tumbler has one or more protruding teeth 106, spaced around the outer surface and centered to the tumbler height. The outer tumbler has a radial array of channels or blind slots 108 cut away on its inside diameter surface from one end. The number of slots equal the number of indicia, in this case twenty-six, for the full alphabet. The fit between the teeth and the slots provide for a slight frictional fit between inner and outer tumblers such that once assembled together both inner and outer tumbler rings act as a single unit. The slot and teeth features allow the inner tumbler to be removed and reoriented such that the keyway may be aligned with any one of the twenty-six letters. The keyway indicator 74 is present on the external surface of the outer tumbler. Similar to the preferred embodiment tumbler, the inner tumbler has the identical features of a locking rib with a keyway opening, detent v-shaped notches cut through the rib, pick resistant recessed surface features, etc. Although this two pieces tumbler embodiment increases the number of parts used by five (one for each of the five tumblers), it eliminates the necessity of applying additional labels when a new code is desired. As in the preferred embodiment, this design still provides the end user the benefits of quick and easy initial set up of a code word. The keyways of inner tumblers would come preassembled and aligned with the indicator marks on the outer tumblers. Labels and code word letters could be applied without having to take apart the container. In this embodiment, it would only be necessary to disassemble the two piece tumblers when a new code word is desired.

OPERATION—ALTERNATIVE EMBODIMENT—TWO PIECE TUMBLER

Just as in the preferred embodiment, the device would be offered to the end user with housing and tumblers pre-assembled, along with a set of labels-one for each tumbler. The directions for setting up the device with a personal code word would be identical to that described above in the preferred embodiment. Changing the code word would require these additional following steps:

1. Using the existing code word, separate the housings and remove the tumblers.
2. For each tumbler, separate the inner tumbler ring from the outer tumbler ring.
3. Reorient the inner tumbler's keyway such that it is positioned below and aligned with the newly chosen letter.
4. Reinsert/nest the inner tumbler back into the outer tumbler.
5. Repeat the process for the other four tumblers choosing new selected letters.
6. Reassemble the tumblers onto the upper housing with new code word aligned with the marker
7. Insert bottle of wine
8. Reinsert lower housing and scramble tumblers FIGS. 8-A & 8-B show that the upper housing can be modified to provide other permutations and usages for the device. FIG. 8-A shows the use of the device as a locking container for securing medicines 96. FIG. 8-B shows the use of the device as a piggy bank 98.

FIGS. 9-A & 9-B show an alternative embodiment where the cylindrical nesting, keying and detent features on upper and lower housings could easily be reversed. As shown, the outside diameter of the upper housing would fit into the inside diameter of the lower housing; the lower housing would have a slot in its cylindrical wall to accept the key feature of the upper housing; and detent features would be formed on the outer cylindrical surface of the lower housing. The tumblers (not shown) and their locking ribs when assembled would bear radially against the lower housing's outside diameter.

CONCLUSION, RAMIFICATIONS, AND SCOPE

Accordingly, the reader will see that the locking container of this invention can be easily set up and used as a game/puzzle for a wine bottle, and can have permutations for use in storing medicines or as a toy coin bank. The device uses of the fewest number of parts while providing all design functions, can be mass produced, and can be made available to consumers for a reasonable price. This invention differentiates itself mechanically from other prior art by:

- using housings specifically designed for acceptance of a wine bottle;
- using two integral keys, one on each housing, that along with a set of locking tumblers, can fully lock and retain the assembly—additional retaining components, i.e. posts, screws, retaining rings, etc., are not required;
- using a keyway indicator, whereby it's visibility on the exterior tumbler surface eliminates the need for any disassembly in setting up a personalized code word;
- using labels as simple means for externally applying indicia;
- using integrally molded indexing features, formed into the housing wall, that engage the tumblers and provide a detent function without the requirement of additional parts; and
- using features that provide pick resistance.

Although the description above contains many specifications, these should not be construed as limiting the scope of the invention but as merely providing illustrations of some of the presently preferred embodiments of this invention. For example the two housings do not have to necessarily engage or nest into each other concentrically. As shown and described in an alternative embodiment, the cylindrical nesting, keying and detent features on upper and lower housings could easily be reversed/"swapped" and still provide all essential mechanical functions. Indicia may be applied externally to the tumblers in any number of ways which could include indicia plates, split rings, clasps with snap features, hook and loop material (commonly known as Velcro™), or as elastic material stretched and bonded to each tumbler. The indicia do not necessarily have to be alphabetic letters. For instance, symbols, numerals, or even words could be used. One variation for indicia could utilize abbreviations for words that describe the wine held within the container. For instance, one set of indicia for a tumbler could use abbreviations for the wine's country of origin such as "USA", "AUS", "NZ", etc. Another set of indicia could be a range of two digit numerals representing vintage years. A third indicia set might use abbreviations for wine varietal such as "CAB", "MER" (cabernet sauvignon, merlot, etc). Fourth and fifth indicia sets could include taste or quality descriptors of the wine—"SMK", "CHY", "TAN" (smoky, cherry, tannin, etc.). Solving the puzzle would require determining all of the wine's characteristics as opposed to a single code word. The locking keys may have a shape or profile different than the above described rectangular tabs, for example—cylindrical pins could be used. The detent features, integrally molded in the upper housing, can be formed in a variety of ways other than as cantilevered tabs. Likewise, the detent features do not necessarily have to make contact with the locking rib v-shaped notches but could also engage with a different internal surface or feature inside the tumbler. Thus the scope of the invention should be determined by the appended claims and their legal equivalents, rather than the examples given.

I claim:

1. A combination lock container comprising:

(a) a plurality of locking tumblers;

(b) an upper housing; and (c) a lower housing;

said locking tumbler being ring shaped or annularly formed and having inside and outside diameter surfaces, upper and lower planar edge surfaces, said locking tumbler having means for acceptance of programmable indicia onto the outer circumference, internal surface of the tumbler having an annular locking rib projecting inwardly and centered with respect to the tumbler height, said annular locking rib having a portion of its wall section removed thereby creating a keyway opening, said upper housing being generally hollow and having:

a cylindrical wall with lower end being open;

a flat or planar flange portion extending radially from top edge of said cylindrical wall;

a head portion enclosing top end of said cylindrical wall;

an upper housing key formed longitudinally on outer surface of said cylindrical wall and oriented in the direction of cylinder axis, said upper housing key comprising a linear array of protrusions sequentially spaced with gap openings between said protrusions; said upper housing containing a longitudinal slot penetrating through one side of said cylindrical wall section and adjacent to said upper housing key; said upper housing having an index marker on said head portion with angular alignment to the key feature;

said lower housing being generally hollow and having:

a cylindrical wall with upper end being open;

a flat or planar flange portion extending radially from bottom edge of said cylindrical wall;

a bottom wall section enclosing lower end of said cylindrical wall;

a lower housing key formed longitudinally on outer surface of said cylindrical wall and oriented in the direction of cylinder axis, said lower housing key comprising a linear array of protrusions sequentially spaced and with gap openings between said protrusions;

whereby the cylindrical wall portions of upper and lower housings are of size and diameter to permit concentric nested interengagement such that the lower housing cylindrical wall portion fits up and into the upper housing cylindrical wall portion, said longitudinal slot of said upper housing is sized and located for acceptance of said lower housing key, wherein said protrusions and gap openings of said keys for both housings are in lateral alignment and adjacent to each other when said upper and lower housings are fully engaged, wherein said plurality of locking tumblers may be rotatably mounted and placed onto said upper housing and captured between upper and lower housing flanges, wherein the flanges fully cover the open sides of uppermost and lowermost tumblers; wherein the width of the tumbler key opening is greater than that of both adjacent and laterally aligned housing tabs, wherein the locking ribs of installed tumblers are in alignment with and engage said gap openings of both keys thereby providing interlocking between the housings, whereby the container may only be opened and contents within accessed when indicia of tumblers are positioned in a selected manner on the container beneath said index marker to an unlocked condition with all tumbler keyways in radial alignment with the housing keys, thereby permitting the housings to be separated axially.

2. A combination lock container of claim 1 wherein:

said head portion of said upper housing is formed with size, shape, and contour similar to that representing an upper neck portion of a bottle, whereby enclosed volume of the container is suitable to fully accept said bottle.

3. A combination lock container of claim 1 wherein:

said upper housing has a slot opening for acceptance of coins to permit the container to be used as a coin vault.

4. A combination lock container of claim 1 wherein:

upper housing cylindrical wall section has a plurality of integrally molded flexible detent features, wherein said annular locking rib of the tumbler has a radial array of v-shaped notches or teeth, whereby the notches engage the detent features to provide ratcheting or index positioning for tumblers during rotation.

5. A combination lock container of claim 1 wherein:

the outer surface of the tumbler has a keyway indicator or marking, whereby the indicator may be used for positioning and aligning externally applied programmable indicia.

6. A combination lock container of claim 1 wherein:

each tumbler has one or more stepped or relieved areas on the flat surfaces that form said annular locking rib, whereby said relieved areas provide false indicators and act as a deterrent when picking of locking mechanism is attempted by means of rotating tumblers while concurrently loading the keys against the locking ribs.

7. A combination lock container of claim 1 wherein:

said programmable indicia comprise adhesive backed opaque label strips with printed indicia on opposing surface, whereby wrapping and applying the adhesive label strips around the tumbler's circumference provides a coded letter for each tumbler.

8. A combination lock container of claim 1 wherein:

said programmable indicia comprise two or more split ring pieces, each of said split ring pieces being a partial radial section of an annulus, cylinder, or toroidal ring, said split ring pieces having indicia visible on external surfaces, internal surfaces of said split rings having adhesive for providing means of attachment to the external surface of tumblers, whereby one set of split ring pieces applied to a tumbler fully circumscribe the tumbler.

9. A combination lock container of claim 1 wherein:

said programmable indicia consist of hinged clasp rings with indicia visible on external surfaces, each of said hinged clasp rings comprising two halves of an annulus, cylinder, or toroidal ring, wherein both ring halves are joined at one end by flexible hinge means, wherein the open ends of the clasp ring have features which provide means for attaching or detaching one open end to the other, whereby each clasp ring may secure itself tightly around the tumbler circumference thus providing externally applied indicia.

10. A combination lock container comprising:

(a) a plurality of locking tumblers;

(b) an upper housing; and (c) a lower housing;

said locking tumbler being ring shaped or annularly formed and having inside and outside diameter surfaces, upper and lower planar edge surfaces, said locking tumbler having means for acceptance of programmable indicia onto the outer circumference, internal surface of the tumbler having an annular locking rib projecting inwardly and centered with respect to the tumbler height, said annular locking rib having a portion of its wall section removed thereby creating a keyway opening, said upper housing being generally hollow and having:

a cylindrical wall with lower end being open;

a flat or planar flange portion extending radially from top edge of said cylindrical wall;

a head portion enclosing top end of said cylindrical wall;

an upper housing key formed longitudinally on outer surface of said cylindrical wall and oriented in the direction of cylinder axis, said upper housing key comprising a linear array of protrusions sequentially spaced with gap openings between said protrusions; said upper housing having an index marker on said head portion with angular alignment to the key feature;

said lower housing being generally hollow and having:

a cylindrical wall with upper end being open;

a flat or planar flange portion extending radially from bottom edge of said cylindrical wall;

a bottom wall section enclosing lower end of said cylindrical wall;

a lower housing key formed longitudinally on outer surface of said cylindrical wall and oriented in the direction of cylinder axis, said lower housing key comprising a linear array of protrusions sequentially spaced and with gap openings between said protrusions; said lower housing containing a longitudinal slot penetrating through one side of said cylindrical wall section and adjacent to said lower housing key;

whereby the cylindrical wall portions of upper and lower housings are of size and diameter to permit concentric nested interengagement such that the outside diameter of the upper housing cylindrical wall portion may be inserted into the inside diameter of the lower housing cylindrical wall portion, said longitudinal slot of said lower housing is sized and located for acceptance of said upper housing key, wherein said protrusions and gap openings of said keys for both housings are in lateral alignment and adjacent to each other when said upper and lower housings are fully engaged, wherein said plurality of locking tumblers may be rotatably mounted and placed onto said upper housing and captured between upper and lower housing flanges, wherein the flanges fully cover the open sides of uppermost and lowermost tumblers;

wherein the width of the tumbler key opening is greater than that of both adjacent and laterally aligned housing tabs, wherein the locking ribs of installed tumblers are in alignment with and engage said gap openings of both keys thereby providing interlocking between the housings, whereby the container may only be opened and contents within accessed when indicia of tumblers are positioned in a selected manner on the container beneath said index marker to an unlocked condition with all tumbler keyways in radial alignment with the housing keys, thereby permitting the housings to be separated axially.

* * * * *